United States Patent [19]

Boutellier

[11] Patent Number: 4,735,562

[45] Date of Patent: Apr. 5, 1988

[54] APPARATUS FOR CASTING AND INVERTING CONCRETE PRODUCTS

[76] Inventor: Harold L. Boutellier, 32 Broughton Crescent, Red Deer, Alberta, Canada, T4N 1C8

[21] Appl. No.: 19,827

[22] Filed: Feb. 27, 1987

Related U.S. Application Data

[63] Continuation-in-part of Ser. No. 847,209, Apr. 2, 1986.

[51] Int. Cl.[4] ..... B28B 7/08

[52] U.S. Cl. ..... 425/62; 249/86; 249/120; 249/132; 249/137; 425/424; 425/439

[58] Field of Search ..... 425/62, 111, 432, 439, 425/424; 249/75, 86, 120, 124, 129, 137, 158, 132; 264/228

[56] References Cited

U.S. PATENT DOCUMENTS

| | | | |
|---|---|---|---|
| 2,721,368 | 10/1955 | Landrum | 249/158 |
| 3,032,851 | 5/1962 | Gibbs | 425/439 |
| 3,190,607 | 6/1965 | Sonneville | 249/137 |
| 4,025,265 | 5/1977 | Auer | 425/439 |
| 4,038,355 | 7/1977 | Bratchell | 264/228 |
| 4,102,957 | 7/1978 | Da Re | 425/111 |
| 4,228,985 | 10/1980 | Gaudelli et al. | 249/137 |
| 4,242,071 | 12/1980 | Stinton | 264/228 |

FOREIGN PATENT DOCUMENTS

| | | | |
|---|---|---|---|
| 417291 | 7/1974 | U.S.S.R. | 249/183 |

*Primary Examiner*—Jay H. Woo
*Assistant Examiner*—James C. Housel
*Attorney, Agent, or Firm*—Newton, Hopkins & Ormsby

[57] ABSTRACT

An apparatus and method for making a plurality of formed concrete products. The apparatus comprises a platform having a mold tray situated thereon, wherein the platform has a built in vibrator and the mold tray is attached to a hydraulic lift system. The hydraulic lift system lifts and inverts the mold tray and cured concrete products for easy removal.

7 Claims, 4 Drawing Sheets

APPARATUS FOR CASTING AND INVERTING CONCRETE PRODUCTS

This is a continuation-in-part of copending application Ser. No. 847,209 filed on Apr. 2, 1986.

BACKGROUND OF THE INVENTION

1. Field of the Invention

This invention relates to the art of casting formed concrete products. More particularly, this invention relates to an apparatus and method for making a plurality of formed products at one time and providing a convenient means for removing the final products from their molds.

2. Description of the Prior Art

Concrete products such as bumper curbs, railroad ties, fence posts, and patio blocks are usually produced in molds that are large and cumbersome to handle. The molded products are usually made either one at a time or in a multicavity mold which requires at least two workers and additional heavy equipment for lifting and inverting the molds to remove the cured product. No single apparatus is available that is capable of forming multiple concrete products while also providing both a vibrating means and means for removing the final formed products.

For example, Gaudelli et al., in U.S. Pat. No. 4,228,985 discloses a mold bed having a number of mold cavities wherein the molded parts are readily removable by suspending the entire mold bed and formed products on a pedestal and turning the bed upside-down to eject the molded parts by gravity. Several disadvantages are inherent in this type of apparatus. First, the mold bed when filled with concrete is very heavy and it takes at least two men or a forklift to place it on the pedestals prior to inversion. Furthermore, should one desire to vibrate the wet cement mixture after it is poured into the molds, one would have to attach a separate vibrator system. Also, the Gaudelli et al. mold bed lacks versatility in that it can only be used for making elongated mold products such as concrete spacers used in parking lots.

Bratchell, U.S. Pat. No. 4,038,355 teaches combining a multi-cavity mold with a tilt device for lifting one side of the mold to pivot it about a longitudinal axis, lowering the mold, and inverting it in order to discharge the concrete ties formed therein. There are several disadvantages encountered with the production method disclosed in Bratchell. First, effective use of the tilt mold frame requires additional heavy machinery, for example mounting a separate vibrator on to the hopper which is filled with wet cement. Secondly, a forklift truck must be used to support the filled mold prior to the lifting and tilting steps. Also, in order to lift the mold frame containing the formed concrete ties, it is necessary to provide a hoist system which is attached to a crane.

As is evident from the above discussion of the prior art, what is needed is an apparatus capable of making a plurality of formed concrete products having all the necessary equipment for making the products incorporated into a single apparatus that can be operated by just one person with minimum manual effort.

SUMMARY OF THE INVENTION

A major objective of the present invention is to provide an apparatus for making a plurality of pre-cast concrete products in mold trays of various types that can be operated by a single person.

Another major objective is to provide an apparatus having a vibrator means attached thereto for vibrating the mold trays containing the wet cement mixture.

Another objective of the present invention is to provide an apparatus having a lift means incorporated therein for lifting and inverting the mold trays to remove the formed concrete products from the mold cavities.

A still further objective is to provide an apparatus having a vibrating platform that will accomodate a variety of mold patterns including but not limited to bumper curbs, patio blocks, fence posts, and railroad ties.

Another objective is to provide a tapered pin to be inserted into those molds that are used for making elongated concrete forms which will be anchored in place with steel pins or rods, and a convenient bayonet mount for removing the pins after the concrete has cured.

Another major objective is to provide a new reinforcement bar (rebar) support system which slideably mounts on to the tapered pins for suspending the reinforcing bars therefrom.

Another objective is to provide a movable apparatus having retractable wheels to enable the production of concrete products to be carried out either indoors or outdoors or actually on the job site.

It is yet another objective to provide a method and apparatus for making formed concrete products which is more efficient, less expensive, and ultimately reduces the production cost of the products.

Briefly, the apparatus of this invention comprises a generally rectangular platform having two side edges, a front and back edge, a top and bottom surface, and a detachable mold tray having a plurality of mold cavities situated on the top surface of the platform.

The supporting frame for the apparatus comprises two L-beams, one situated along each side edge of, and in an essentially parallel relationship to, the platform. Each L-beam has a rearwardly positioned vertically extending member, a horizontally extending member, and at least two inwardly projecting support beams attached to the horizontal member. The L-beams are connected by at least one connecting beam extending between the vertical members.

A means for lifting and inverting the mold tray is attached to the support frame. Also, at least one motor-actuated vibrator is attached to the bottom surface of the platform.

A detachable retainer means is also included for temporarily securing the formed concrete products in the mold cavities prior to removal, when the mold tray is in its inverted position.

The apparatus also includes upwardly projecting tapered pins in the molds to form correspondingly shaped holes in the formed concrete product. A reinforcing bar support system is adapted to slideably engage the upwardly extending tapered pins. The support system comprises a hollow cylinder having two radially outwardly projecting rods upon which the reinforcing bars rest. An internal stop is located inside the hollow cylinder to control the position of the support system relative to the tapered pin.

Briefly, the method of making a plurality of concrete products comprises the following steps:

(1) providing a mold tray having a plurality of mold cavities on a platform which is supported by a frame, the mold tray being attached to a hydraulically controlled lift system for lifting and inverting the mold tray and for removing the formed concrete products from the mold cavities;

(2) providing the platform with an attached vibrator means;

(3) forming a wet mixture of concrete;

(4) pouring the wet mixture of concrete into the molds;

(5) placing a retainer means across the tops of the molds for temporarily securing the formed product in the molds prior to removal when the mold tray is in its inverted position;

(6) vibrating the platform, the mold tray and the wet mixture in the molds to sift the finer and heavier particles within the wet mixture to the bottom of the molds and to eliminate any voids;

(7) allowing the concrete to cure;

(8) lifting the mold tray with a hydraulically controlled lift system;

(9) inverting the mold tray;

(10) lowering the mold tray until the retainer means rests on the platform;

(12) detaching the retainer means; and

(13) raising the mold tray, leaving the formed concrete products on the platform for removal.

DETAILED DESCRIPTION OF THE DRAWINGS

Figure 1:
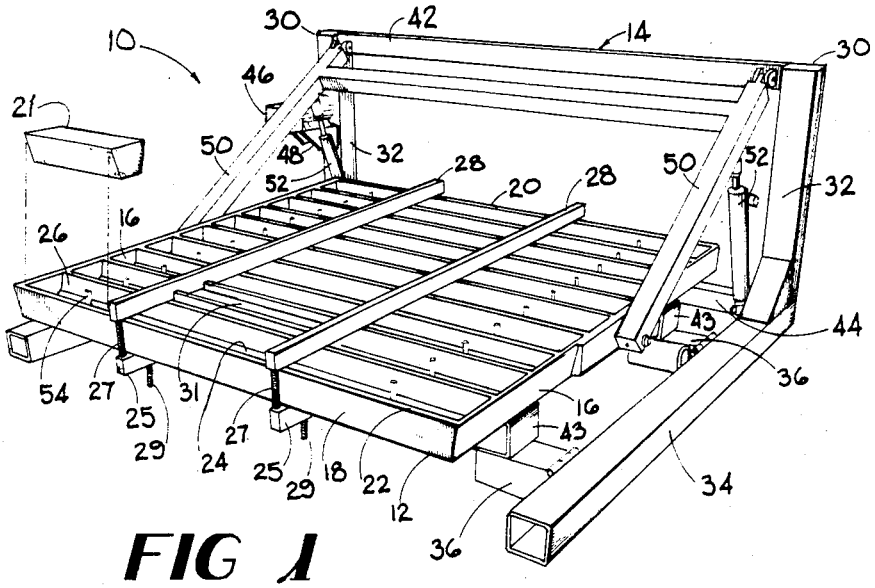
FIG. 1 is a perspective view of the concrete forming apparatus.

Referring now in detail to the drawings, one embodiment of molding apparatus 10 is illustrated in FIG. 1. In this embodiment, apparatus 10 is provided with a rectangular platform 12 mounted on frame 14.

Figure 8:
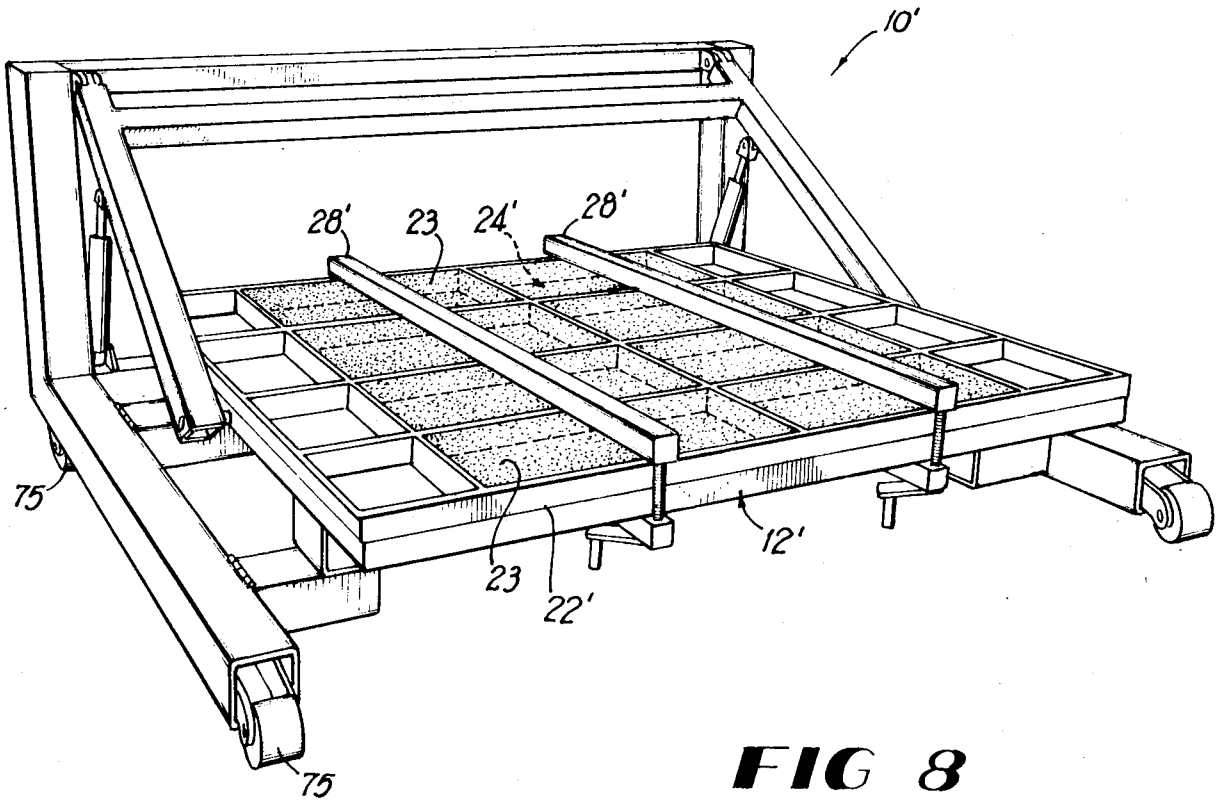
FIG. 8 is a perspective view of an alternate embodiment of the apparatus.

Platform 12 is made up of side edges 16, front edge 18, and back edge 20, and having a top surface 22 which, in the embodiment illustrated in FIG. 1, also serves as the bottom of mold cavities 24. Mold cavities 24 are formed as integral components of platform 12 by inserting and securing side walls 26 to extend longitudinally between side edges 16. An alternate construction for platform 12' and mold cavities 24' is illustrated in FIG. 8. In this alternate embodiment, platform 12' is manufactured separately as a flat planar surface so that individual mold trays may be attached to the top surface 22'. This enables one to use apparatus 10' for casting a variety of formed concrete products. For example, a tray having a plurality of longitudinal mold cavities, similar to that illustrated in FIG. 1, or patio block forms 23 as shown in FIG. 8, can be placed on top of platform 12' and secured thereto by retainer bars 28' or any other conventional means.

Referring back to the embodiment in FIG. 1, two retainer bars 28 are placed across the tops of mold cavities 24 and secured to cross bars 25 which extend across bottom surface 40 of platform 12 between back edge 20 and front edge 18. Cross bars 25 are held in place by vibrator housing 39 shown in FIG. 5. Retainer bars 28 and cross bars 25 have threaded shafts for receiving screw members 27 which are rotated into place by wheel crank 29. While the primary function of the retainer bars 28 is to temporarily secure the formed concrete products in the molds when platform 12 is in its inverted position, they also serve to maintain individually constructed molds in place when placed on top surface 22' of platform 12', as shown in FIG. 8. It may be necessary to vary the number and placement of retainer bars 28 and 28' depending upon the mold forms being used.

When bumper curbs are being made, void pans 31 may be attached to retainer bars 28 to provide an indentation in the formed bumper curb for water drainage. Also, end inserts 21 can be placed inside mold cavities 24 to produce bumper curbs of varying length.

Frame 14 supports platform 12 and is made up of two L-beams 30, one situated along each side edge 16 of platform 12 in an essentially parallel relationship thereto. Each L-beam 30 has a rearwardly positioned vertically extending member 32 and a horizontally extending member 34. At least two inwardly projecting hinged support beams 36 are attached to each L-beam 30 for supporting platform 12 above the ground to allow vibrators 38 enclosed in vibrator housing 39 and vibrator motor 41 to be attached to bottom surface 40 of platform 12 (see FIG. 5) so that they can vibrate freely without touching the ground. Platform blocks 43 are attached to bottom surface 40 of platform 12 and also function to support platform 12 at its proper height above the ground. L-beams 30 are connected by two connecting beams, the first connecting beam 42 extends between the top portions of vertical members 32 and the second connecting beam 44 extends between the bottom portions of vertical members 32. Additional connecting beams may be added should extra reinforcement of the frame structure be desired.

Figure 3:
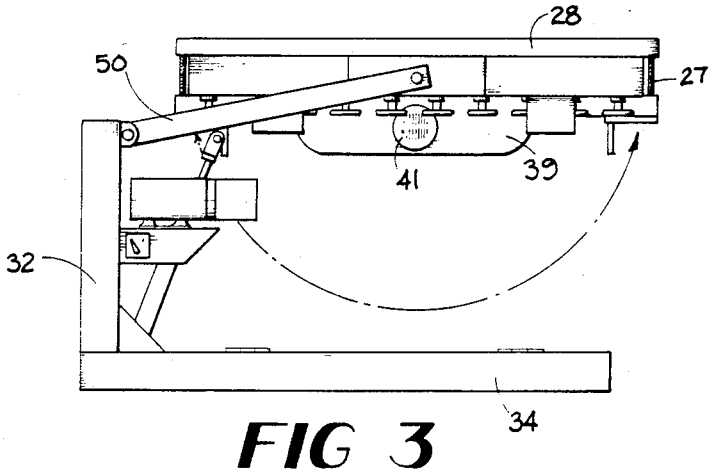
FIG. 3 is a side elevation of the apparatus showing the mold platform in an upright raised position.
Figure 4:
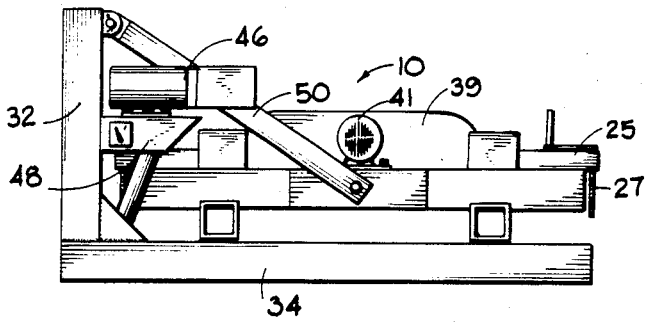
FIG. 4 is a side elevation of the apparatus showing the mold platform in an inverted lowered position.

Platform 12 is attached to a hydraulically controlled lift system consisting of an electric motor 46 located on mounting box 48 which is secured to vertical member 32 of L-beam 30. Two lift arms 50 are pivotally attached at each end to the first connecting beam 42 and side edges 16, one lift arm 50 being attached to each side edge 16 of platform 12. Each lift arm 50 is then attached to a hydraulic cylinder 52 which, when activated by electric motor 46, raises platform 12 to its elevated position, as illustrated in FIG. 3. The height attained must be sufficient to permit a 180° rotation of platform 12. Inversion of platform 12 is usually performed manually by grasping side edge 16 and rotating 180°. Rotation may be facilitated by attaching a steering wheel (not shown) to side edge 16 or by adding a second hydraulic system.

Figure 6:
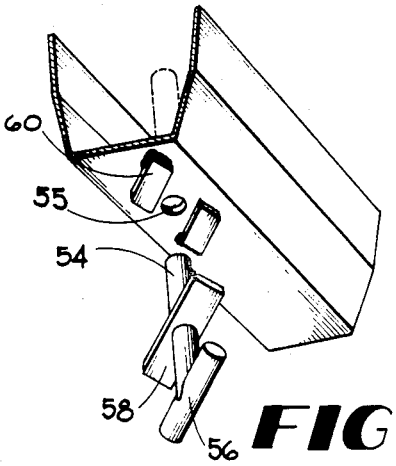
FIG. 6 is an enlarged perspective of the tapered pin bayonet mount.

When concrete bumper curbs are being molded, the final product often has two vertically extending holes for inserting rods to anchor the bumper curbs in place wherever they are being used, for example in parking lots or along the road side. These holes are formed by inserting at least two upwardly projecting tapered pins 54 into mold cavity 24, as shown in FIG. 1. After the concrete has been poured into the mold and allowed to cure, tapered pins 54 are removed. A bayonet mount release system has been found to be convenient for securing and removing tapered pins 54. As illustrated in FIG. 6, tapered pin 54 is constructed having a T-handle 56 for rotating and engaging locking plate 58 with locking tabs 60 which are attached to bottom surface 40 of platform 12.

Figure 7:
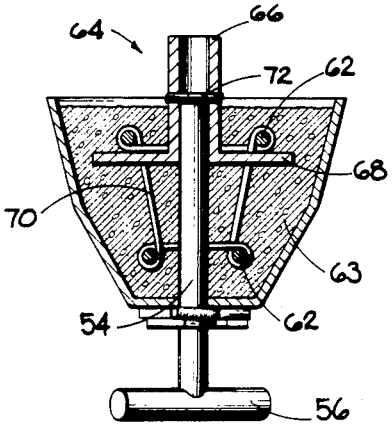
FIG. 7 is an enlarged cross-section of a mold cavity showing the reinforcing bar support system.

Many formed concrete products have inserted therein steel or metal reinforcing bars (rebars) to improve the strength of the formed product. Generally bumper curbs have four reinforcing bars 62 positioned within the formed product as illustrated in FIG. 7. The conventional way of suspending the rebars has been to insert either metal or concrete supports at the bottom of mold cavity 24 in order to keep the rebars 62 positioned centrally within the wet cement 63. The disadvantage with using metal supports is that rust spots appear as the top of the bumper curb wears away. When concrete supports are used, the top surface of the bumper curb eventually becomes irregular.

In order to avoid the problems of the prior art, a new rebar support system 64 has been designed and is illustrated in FIG. 7. Rebar support system 64 is made up of a hollow cylinder 66 having an internal diameter of a size sufficient to slideably engage tapered pin 54. Two radially projecting rods 68 extend outwardly from cylinder 66 and serve to support two rebars 62. To suspend additional rebars, wrapped wire 70 is looped around the rebars resting on rods 68 and then extended downwardly to loop around the additional rebars positioned in the mold. In order to assure proper positioning of rebars 62, internal stop 72 is inserted in cylinder 66 to allow support system 64 to assume the desired position relative to tapered pin 54. When the wet concrete 63 becomes partially cured, cylinder 66 is rotated 90° and slid upwardly out of the partially cured cement. Rebars 62 remain fixed in their location, as illustrated in FIG. 7.

In some instances, especially when molding fence posts for a noise barrier fence at the job site, it is convenient to be able to move apparatus 10 as the construction progresses. To this end, retractable wheels 75 can be attached to L-beams 30 as shown in FIG. 8. Wheels 75 also provide an easy means of moving apparatus 10 to the inside or outside depending on the weather.

Figure 9:
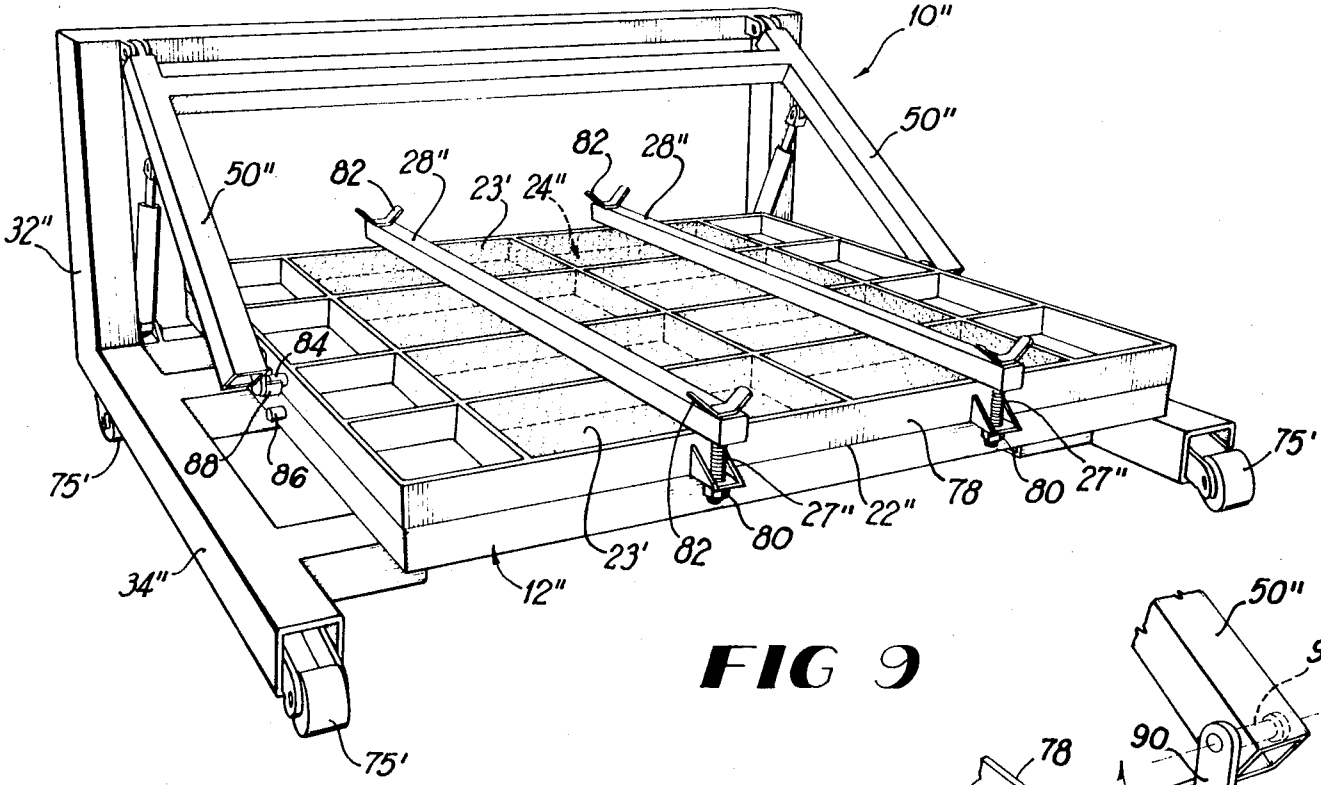
FIG. 9 is a perspective view of a second alternate embodiment of the apparatus.
Figure 10:
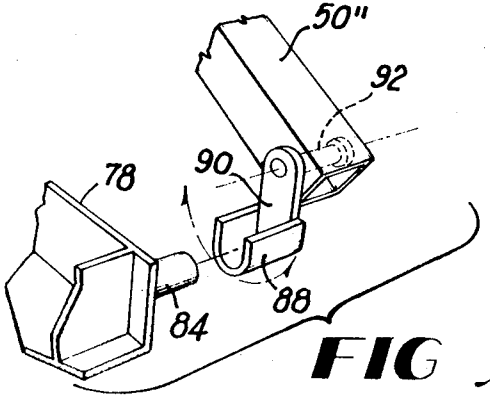
FIG. 10 is a fragmentary perspective view of a portion of the apparatus illustrated in FIG. 9.

A second alternate embodiment, molding apparatus 10", is illustrated in FIG. 9. The major difference between apparatus 10" and those illustrated in FIGS. 1 and 8 is that only mold tray 78 and not the platform 12" is lifted and inverted for removal of the formed concrete products. Thus, mold tray 78 is rotatably attached to lift arms 50". FIG. 10 illustrates the attachment means whereby side pins 84 are mounted on each side of mold tray 78 and rotatably cradled within U-shaped brackets 88 mounted to lift arms 50". There are several advantages in constructing the apparatus as illustrated in FIG. 9. First, the total weight being lifted by lift arms 50" is decreased considerably because the platform and vibrating motors remain situated on platform blocks 43". Secondly, because mold tray 78 is also detachable from lift arms 50", it may be removed from platform 12" after the mold cavities 24" have been filled with wet cement and the curing step may be carried out elsewhere, allowing apparatus 10" to be used for other mold trays.

Retaining bars 28" extend across mold cavities 24" and are secured to mold tray 78 by any conventional means. Mold tray 78 is illustrated in FIG. 9 as having internally threaded projections 80 for receiving screw member 27" which are secured to retaining bars 28" by wing nuts 82. Alternately, retaining bars 28" may be attached to mold tray 78 by spring mounted clamps (not shown).

Lift arms 50" can also be attached to platform 12" for lifting the platform above the ground for easy cleaning. To facilitate the lifting of platform 12", brackets 88 are pivotally mounted to lift arms 50" via connecting link 90 which is journalled through lift arm 50" by hinge pin 92.

Referring now to the method for making pre-cast concrete blocks, the following steps will describe a method of making patio blocks using the molding apparatus 10", as illustrated in FIG. 9. In this embodiment, molding apparatus 10" is provided with a rectangular platform 12" which is supported by frame 14". Mold tray 78, having a plurality of mold cavities 24", is placed on platform 12".

A hopper (not shown) is provided and filled with wet concrete which is discharged into the mold cavities 24", the hopper being moved across the tops of the molds until mold cavities 24" are filled.

Figure 2:
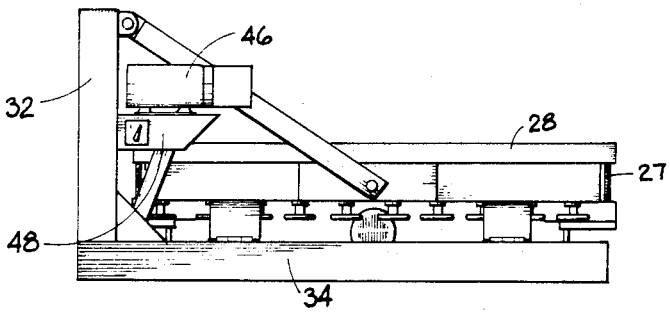
FIG. 2 is a side elevation of the apparatus showing the mold platform in an upright lowered position.
Figure 5:
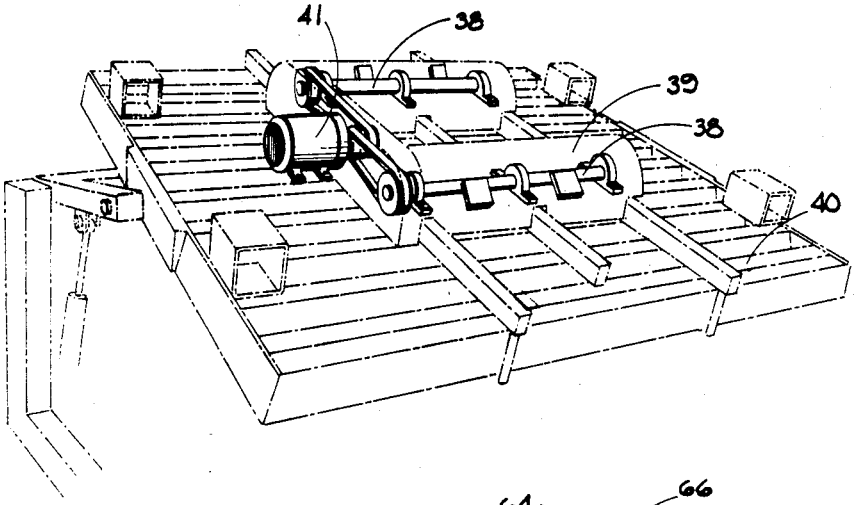
FIG. 5 is a partial perspective showing the bottom surface of the apparatus.

Vibrator motors 41, similar to those shown in FIG. 5, are built in to the bottom surface of platform 12". The vibrator motors are activated by an on-off switch located on mounting box 48 as illustrated in FIG. 2. The wet cement is vibrated within the molds for approximately 3 min. to settle the heavy and fine particles and to remove any air pockets trapped therein. After the vibrating step, mold tray 78 may be removed from platform 12" and the concrete allowed to cure in another location, generally overnight. Apparatus 10" can now be used for other mold trays.

After the concrete has cured, mold tray 78 is placed again on platform 12" making sure that side pins 84 are firmly situtated in brackets 88 on lift arms 50". Mold tray 78 is raised to its elevated position similar to that as illustrated in FIG. 3 and rotated 180°. Mold tray 78 is then lowered until retainer bars 28" rest on platform 12". Retainer bars 28" are released and mold tray 78 is then raised hydraulically, leaving the formed concrete bumper curbs on platform 12". The bumper curbs are lifted onto a transport system for removal to a convenient place for storage.

Although the present invention has been illustrated and described in connection with the above embodiments, it will be understood that this is illustrative of the invention and is by no means restrictive thereof. It is reasonably expected that those skilled in the art can make numerous revisions and adaptations of the invention which is intended to be limited only by the appended claims.

What is claimed is:

1. An apparatus for making a plurality of molded concrete products comprising:

a support frame;

a vibrating platform having two side edges, a front and back edge, and a top and bottom surface;

a mold tray removably situated on the top surface of the platform having a plurality of mold cavities;

means for vibrating the platform and mold tray, the vibrator means being attached to and operatively associated with the platform;

motorized lift means pivotally attached to the support frame for lifting and inverting the mold tray for removal of the formed concrete products, the lift means being adapted to releasably engage the mold tray, said lift means comprising a pair of arms, each arm having a pair of opposite ends and being pivotally mounted at one end to a respective side of said mold tray, and pivotally mounted at the opposite end to said support frame, said lift means further including a means for raising said arms;

detachable retainer means secured to the mold tray for temporarily securing the formed concrete products in the mold cavities prior to removal, when the mold tray is in the inverted position; and control means attached to the apparatus for actuating the vibrator and lift means.

2. The apparatus of claim 1 wherein the vibrating means comprises at least one motor-actuated vibrator attached to the bottom surface of the platform.

3. The apparatus of claim 1 wherein the support frame comprises two L-beams, one situated along each side edge of, and in a generally parallel relationship, to the platform, each L-beam having a rearwardly positioned vertically extending member, a horizontally extending member, and the vertical members of the two L-beams being connected by at least one connecting beam.

4. The apparatus of claim 3 wherein each arm of said lift means extends from the at least one connecting beam of the support frame to the side edge of the mold tray, the arms being pivotally mounted to the support frame and rotatably mounted to the mold tray.

5. The apparatus of claim 4 wherein the means for raising comprises a hydraulically controlled lift system wherein a hydraulic cylinder is attached to each arm.

6. The apparatus of claim 1 further comprising the support frame having a plurality of wheels.

7. The apparatus of claim 1 further comprising a projecting pin mounted to each respective side of the mold tray and a bracket pivotally mounted to each arm of the lift means so positioned thereon to receive the projecting pin in rotatable relationship to permit rotation of the mold tray to an inverted position for removal of the concrete products formed therein.

* * * * *